US008022888B2

(12) United States Patent
Kim et al.

(10) Patent No.: US 8,022,888 B2
(45) Date of Patent: Sep. 20, 2011

(54) ANTENNA DEVICE

(75) Inventors: Ju Hyung Kim, Seoul (KR); Tae Wook Lim, Gyunggi-Do (KR); Seung Mo Park, Gyunggi-Do (KR); Tae Sung Kim, Seoul (KR); Jae Suk Sung, Gyunggi-Do (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 318 days.

(21) Appl. No.: 12/332,280

(22) Filed: Dec. 10, 2008

(65) Prior Publication Data

US 2009/0224996 A1 Sep. 10, 2009

(30) Foreign Application Priority Data

Mar. 4, 2008 (KR) ..... 10-2008-0020014

(51) Int. Cl.
*H01Q 1/50* (2006.01)

(52) U.S. Cl. ..... 343/860

(58) Field of Classification Search ..... 343/860, 343/749, 700 MS, 702
See application file for complete search history.

(56) References Cited

U.S. PATENT DOCUMENTS

| | | | | |
|---|---|---|---|---|
| 6,900,773 | B2 | 5/2005 | Poilasne et al. | |
| 6,903,687 | B1 * | 6/2005 | Fink et al. | 343/700 MS |
| 7,164,387 | B2 * | 1/2007 | Sievenpiper | 343/702 |
| 7,274,338 | B2 | 9/2007 | Ozkar et al. | |
| 7,427,955 | B2 | 9/2008 | Choi et al. | |
| 7,439,918 | B2 * | 10/2008 | Iwai et al. | 343/702 |
| 7,688,275 | B2 * | 3/2010 | Montgomery et al. | 343/844 |
| 2002/0118138 | A1 | 8/2002 | Lindenmeier et al. | |
| 2005/0190018 | A1 * | 9/2005 | Kawai et al. | 333/235 |
| 2006/0145926 | A1 | 7/2006 | Choi et al. | |
| 2007/0146210 | A1 * | 6/2007 | Hilgers | 343/702 |
| 2010/0045553 | A1 * | 2/2010 | Ohira et al. | 343/749 |

FOREIGN PATENT DOCUMENTS

| | | | |
|---|---|---|---|
| DE | 8814993 | | 3/1989 |
| DE | 101063793 | | 9/2002 |
| KR | 1020050117702 | A | 12/2005 |
| KR | 1020060064500 | A | 6/2006 |
| KR | 100606453 | B1 | 7/2006 |

OTHER PUBLICATIONS

Korean Office Action for 10-2008-0020014 issued Jan. 22, 2010.
Mahmoud Basraoui et al. "Wideband, Planar, Log-Periodic Balun" Microwave Symposium Digest, 1998 IEEE MTT-S International, 2, Jun. 7-12, 1998, 785-788.
Official Communication for German Patent Application No. 10 2008 063 198.1 issued Jul. 5, 2011.

* cited by examiner

*Primary Examiner* — Huedung Mancuso
(74) *Attorney, Agent, or Firm* — Lowe, Hauptman, Ham & Berner, LLP

(57) ABSTRACT

An antenna device includes a first radiator receiving a first feed signal, a second radiator spaced apart from the first radiator at a predetermined distance and capacitively coupled with the first radiator, a feed line connected to a feed terminal of the first radiator, and a phase shifter diverging from the feed line, connected to a feed terminal of the second radiator, and supplying a second feed signal having a predetermined phase difference with the first feed signal to the second radiator.

13 Claims, 3 Drawing Sheets

ANTENNA DEVICE

CROSS-REFERENCE TO RELATED APPLICATIONS

This application claims the priority of Korean Patent Application No. 2008-20014 filed on Mar. 4, 2008, in the Korean Intellectual Property Office, the disclosure of which is incorporated herein by reference.

BACKGROUND OF THE INVENTION

1. Field of the Invention

The present invention relates to an antenna device, and more particularly, to an antenna device capable of operating two radiators as one antenna by feeding signals having different phases to the two radiators, respectively.

2. Description of the Related Art

An antenna is a device that transmits or receives radio waves.

The antenna in the field of mobile communications is a passive device which is sensitive to the external environment. The antenna is applied to, e.g., a base station, a repeater or a wireless communication device to receive an electric wave from the outside or transmit an electrical signal generated from a communication device to the outside.

In many cases a built-in antenna of a mobile communication terminal is required to optimize characteristics such as standing-wave matching for each mobile communication terminal to which the antennal is applied. When a bandwidth of the antenna is narrow, many tests need to be conducted for optimization. However, when the bandwidth of the antenna is wide, fewer tests are conducted, accordingly shortening the time for development.

Most of related art antennas for broadcasting reception are external antennas. To optimally receive broadcasting signals, the external antennas must be adjusted to a length of $\lambda/4$ of a frequency band for broadcasting reception. However, a general user cannot normally be aware of an accurate length of the antenna, and therefore it is difficult to obtain an optimum gain in the frequency band that is to be used for broadcasting reception.

In the case of a related art chip antenna, a feed structure and a radiator for a specific frequency band are designed by forming a radiation pattern, which is connected to a feeding part and a ground part, on a dielectric block. When the chip antenna is set in a mobile communication terminal, a frequency characteristic of the chip antenna changes and hence tuning operation is inevitable. However, the tuning operation is accompanied by modifications in the radiation pattern or design of the dielectric block, which causes manufacturing loss.

SUMMARY OF THE INVENTION

An aspect of the present invention provides an antenna device that is capable of broadband operation and can realize a constant radiation characteristic even if a condition of a ground plane on a substrate to which the antenna device is set changes.

According to an aspect of the present invention, there is provided an antenna device including: a first radiator receiving a first feed signal; a second radiator spaced apart from the first radiator at a predetermined distance and capacitively coupled with the first radiator; a feed line connected to a feed terminal of the first radiator; and a phase shifter diverging from the feed line, connected to a feed terminal of the second radiator, and supplying a second feed signal having a predetermined phase difference with the first feed signal to the second radiator.

The phase shifter may cause a phase difference of 180 degrees between the first feed signal and the second feed signal.

The phase shifter may include: a plurality of conductive lines having respectively different electrical lengths; and a selection part selecting one of the plurality of conductive lines.

The plurality of conductive lines may have electrical lengths of $\lambda/2$ for signals of different frequency bands, respectively.

The selection part may be a switching circuit.

The first radiator and the second radiator may be arranged such that one loop antenna is formed by capacitive coupling therebetween.

The first radiator and the second radiator may be symmetrical with respect to each other.

The first radiator and the second radiator may have an inverted F shape.

The antenna device may further include an impedance matching device connected to the feed line.

The impedance matching device may include an active device. The active device may include a varactor diode.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
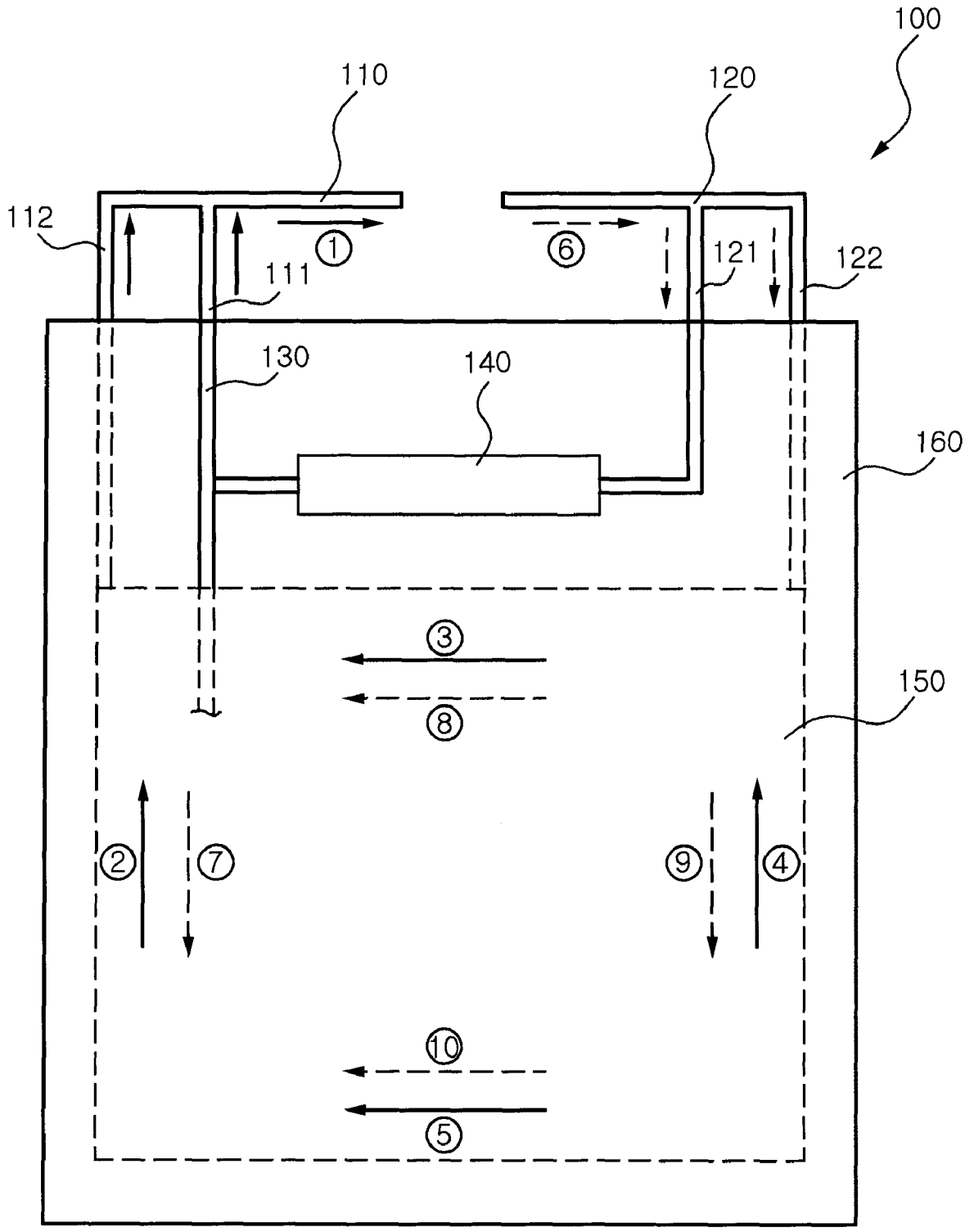
FIG. 1 is a configuration view of an antenna device according to an exemplary embodiment of the present invention.

FIG. 1 is a configuration view of an antenna device according to an exemplary embodiment of the present invention.

Referring to FIG. 1, an antenna device 100 according to the exemplary embodiment of FIG. 1 may include a first radiator 110, a second radiator 120, a feed line 130, and a phase shifter 140.

The first radiator 110 may include a feed terminal 111 and a ground terminal 112, and the feed terminal 111 may be connected to the feed line 130. The ground terminal 112 may be connected to a ground plane 150 disposed on a substrate 160. According to the current embodiment, an inverted F-shaped radiator is used as the first radiator 110. However, the present invention is not limited thereto, and the first radiator 110 may be implemented as an L-shaped radiator or a variety of shapes.

The second radiator 120 may be spaced apart from the first radiator 110 at a predetermined distance, and be capacitively coupled with the first radiator 110. The second radiator 120 may include a feed terminal 121 and a ground terminal 122. The feed terminal 121 may be connected to the phase shifter 140, and the ground terminal 122 may be connected to the ground plane 150 disposed on the substrate 160. The second radiator 120 is a radiator that has the same structure as that of the first radiator 110, and may be arranged symmetrically with respect to the first radiator 110. According to the current embodiment, an inverted F-shaped radiator is used as the second radiator 120. However, the present invention is not limited thereto, and the second radiator 120 may be implemented as an L-shaped radiator or a variety of shapes according to the shape of the first radiator 110.

The feed line 130 is disposed on one surface of the substrate 160. The feed line 130 is connected to the feed terminal 111 of the first radiator 110 at a feeding part (not shown) formed at the substrate 160, and thus supplies a feed signal to the first radiator 110.

The phase shifter 140 may diverge from the feed line 130 and be connected to the feed terminal 121 of the second radiator 120. The phase shifter 140 may supply a second feed signal to the second radiator 120. The second feed signal has a predetermined phase difference with a first feed signal fed to the first radiator 110 through the feed line 130.

The phase shifter 140 may be formed as a strip line. According to the current embodiment, the strip line of the phase shifter 140 has an electrical length of $\lambda/2$ of a frequency signal input to the feed line 130, thereby causing a phase difference of 180 degrees between the first feed signal input to the first radiator 110 and the second feed signal input to the second radiator 120. The phase difference caused by the phase shifter 140 may be implemented variously in due consideration of surroundings and other conditions.

The ground plane 150 may be disposed on the other surface of the substrate 160.

The ground plane 150 may be connected to the ground terminal 112 of the first radiator 110 and the ground terminal 122 of the second radiator 120.

As a current flows to the ground plane 150, the ground plane 150 connected to the first and second radiators 110 and 120 may act as a part of the antenna device. Accordingly, since the entire radiation characteristic of the antenna device varies according to an area of the ground plane 150, tuning may be required.

An operational characteristic of the antennal device according to the current embodiment will now be described.

According to the current embodiment, when a feed signal is supplied to the first radiator 110 along the feed line 130, a current flows through the first radiator 110 in a first current-flow direction ①.

The phase shifter 140 supplies a signal that has a phase difference of 180 degrees with a signal of the feed line 130, to the second radiator 120. Thus, a current flows through the second radiator 120 in a second current-flow direction ⑥, which is identical to the first current-flow direction ① of the first radiator 110.

The first radiator 110 is spaced apart from the second radiator 120 at a predetermined distance. However, the first radiator 110 and the second radiator 120 may be electrically connected together by capacitive coupling, and the current flows in the same direction in the first radiator 110 and the second radiator 120. Accordingly, the first radiator 110 and the second radiator 120 may form a loop providing one current path.

A current path in the ground plane 150 disposed on the other surface of the substrate 160 may be formed by the current path at the first and second radiators 110 and 120. First, current paths formed in the ground plane 150 by the current flowing through the first radiator 110 are indicated by solid-line arrows ②, ③, ④ and ⑤. Current paths formed in the ground plane 150 by the current flowing through the second radiator 120 are indicated by dotted arrows ⑦, ⑧, ⑨ and ⑩.

The current path ② formed at one side portion of the ground plane 150 by the current flowing through the first radiator 110 is in direction opposite to the current path ⑦ formed at the one side portion of the ground plane 150 by the current flowing through the second radiator 120. Accordingly, the current path ② and the current path ⑦ cancel each other.

In the same manner, the current path ④ formed at the other side portion of the ground plane 150 is in a direction opposite to the current path ⑨ at the other side portion of the ground plane 150. Accordingly, the current path ④ and the current path ⑨ cancel each other.

The ground surface 150 may act as a part of the antenna device as a current flows in the ground plane 150 connected to the first and second radiators 110 and 120. Thus, since the radiation characteristic of the antenna device varies according to an area of the ground part, tuning may be required. However, in the antenna device as in the current embodiment, some of the current paths formed in the ground plane 150 cancel each other. That is, the current paths ② and ⑦ cancel each other, and the current paths ④ and ⑨ also cancel each other. Only the current paths ③ and ⑧ among the current paths formed in the ground plane 150 can take part in forming a current path of the entire antenna device. Accordingly, changes in area of the ground plane 150 may not significantly change an antenna characteristic.

Figure 2:
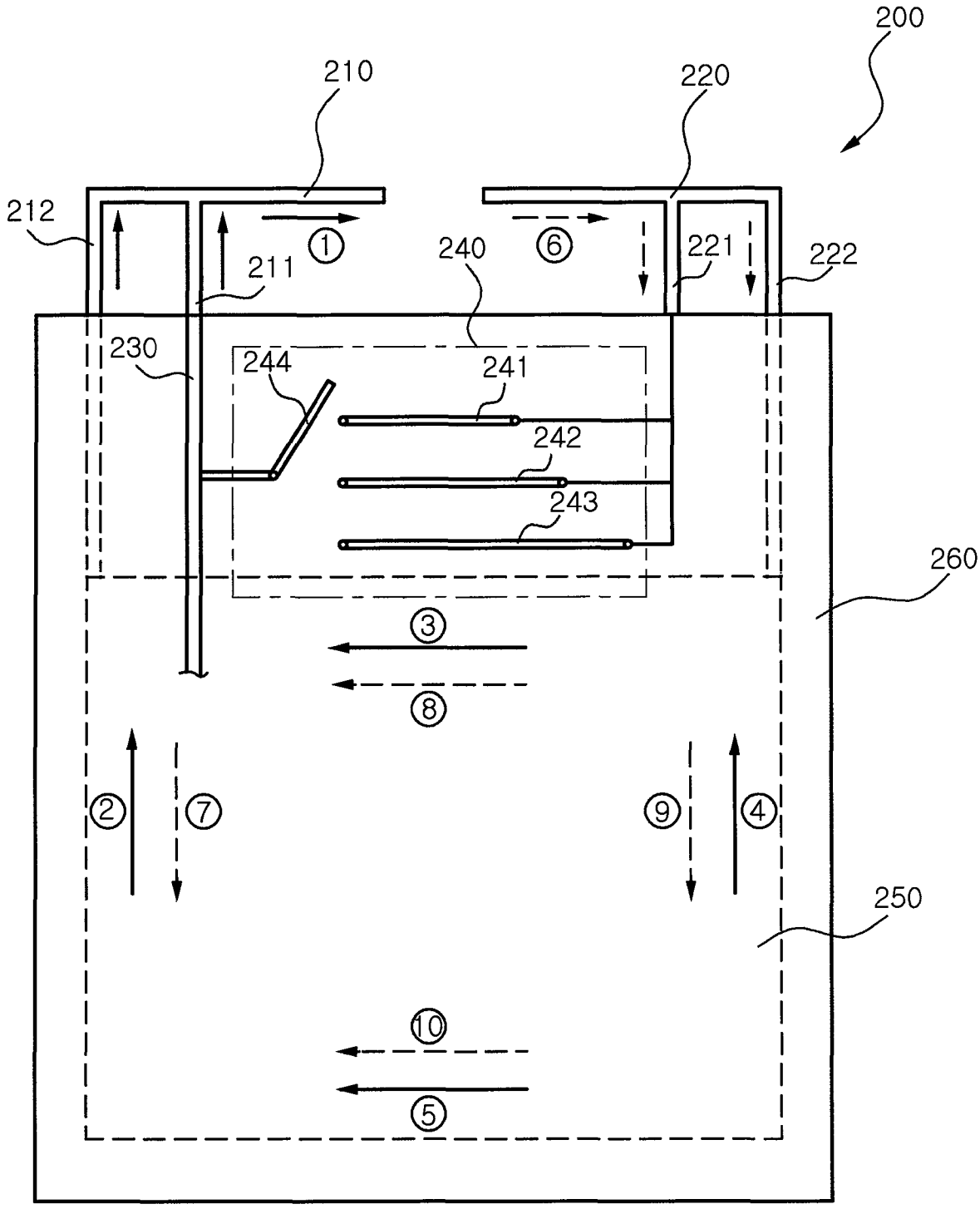
FIG. 2 is a configuration view of an antenna device according to another exemplary embodiment of the present invention.

FIG. 2 is a configuration view of an antennal device according to another exemplary embodiment of the present invention.

Referring to FIG. 2, an antenna device 200 according to the current embodiment may include a first radiator 210, a second radiator 220, a feed line 230 and a phase shifter 240.

The first radiator 210 may include a feed terminal 211 and a ground terminal 212. The feed terminal 211 may be connected to a feed line 230, and the ground terminal 212 may be connected to a ground plane 250 disposed on a substrate 260. According to the current embodiment, an inverted F-shaped radiator is used as the first radiator 210. However, the present invention is not limited thereto, and the first radiator 210 may be implemented as an L-shaped radiator or a variety of shapes.

The second radiator 220 may be spaced apart from the first radiator 210 at a predetermined distance, and be capacitively coupled with the first radiator 210. The second radiator 220 may include a feed terminal 221 and a ground terminal 222. The feed terminal 221 may be connected to the phase shifter 240, and the ground terminal 222 may be connected to the ground plane 250 disposed on the substrate 260. The second radiator 220 is a radiator having the same structure as that of first radiator 210, and may be arranged symmetrically with respect to the first radiator 210. According to the current embodiment, an inverted F-shaped radiator is used as the second radiator 220. However, the present invention is not limited thereto, and the second radiator 220 may be implemented as an L-shaped radiator or a variety of shapes according to the shape of the first radiator 210.

The feed line 230 may be placed on one surface of the substrate 260. The feed line 230 may be connected to the feed terminal 211 of the first radiator 210 at a feeding part (not shown) formed at the substrate 260 and thus supply a feed signal to the first radiator 210.

The phase shifter 240 may diverge from the feed line 230 and be connected to the feed terminal 221 of the second radiator 220. The phase shifter 240 may supply a second feed signal to the second radiator 220. The second feed signal has a predetermined phase difference with a feed signal fed to the first radiator 210 through the feed line 230.

The phase shifter 240 may be formed as a strip line. The strip line of the phase shifter 240 may have an electrical length of $\lambda/2$ of a frequency signal input to the feed line 230, thereby causing a phase difference of 180 degrees between a signal input to the first radiator 210 and a signal input to the second radiator 220. The phase difference caused by the phase shifter 240 may be implemented variously in due consideration of surroundings and various circumstances.

According to the current embodiment, the phase shifter 240 may include a plurality of conductive lines 241, 242 and 243, and a switching circuit 244.

The plurality of conductive lines 241, 242 and 243 may have electrical lengths of $\lambda/2$ for respectively different frequency signals. The conductive lines 241, 242 and 243 each may have one end connected to the feed terminal 221 of the second radiator 220, and the other end 241 which is open.

The switching circuit 244 may connect the open end of one of the plurality of conductive lines 241, 242 and 243 to the feed line 230. The switching circuit 244 may select one of the plurality of conductive lines 241, 242 and 243 according to a frequency signal input from the feed line 230. The switching circuit 244 may be implemented variously. For example, the switching circuit 244 may be implemented by connecting a diode to the open end of each of the conductive lines 241, 242 and 243.

As described above, according to the current embodiment, the phase shifter 240 includes the plurality of conductive lines 241, 242 and 243 having respectively different electrical lengths. Therefore, an electrical length of the phase shifter 240 can be properly selected depending on a frequency signal being input to the antenna device. The antenna device 200 can operate for a frequency signal in a broader band.

The ground plane 250 may be disposed on the other surface of the substrate 260.

The ground plane 250 may be connected to the ground terminal 212 of the first radiator 210 and to the ground terminal 222 of the second radiator 220.

The ground plane 250 connected to the first and second radiators 210 and 220 may act as a part of the antenna device as current flows to the ground plane 250. Accordingly, since the entire radiation characteristic of the antenna device varies according to an area of the ground plane, tuning may be required.

An operational characteristic of the antenna device 200 according to the current embodiment will now be described.

According to the current embodiment, when a feed signal is supplied to the first radiator 210 along the feed line 230, a current flows through the first radiator 210 in a first current-flow direction ①.

The phase shifter 240 supplies a signal that has a phase difference of 180 degrees with a signal of the feed line 230, to the second radiator 220. Thus, a current flows through the second radiator 220 in a second current-flow direction ⑥, which is identical to the first current-flow direction ① of the first radiator 210.

The first radiator 210 is spaced apart from the second radiator 220 at a predetermined distance. However, the first radiator 210 and the second radiator 220 may be electrically connected together by capacitive coupling, and the current flows in the same direction in the first radiator 210 and the second radiator 220. Accordingly, the first radiator 210 and the second radiator 220 may form a loop providing one current path.

A current path may be formed in the ground plane 250 disposed on the other surface of the substrate 260 by the current path formed at the first and second radiators 210 and 220. First, current paths formed in the ground plane 250 by the current flowing through the first radiator 210 are indicated by solid-line arrows ②, ③, ④ and ⑤. Current paths formed in the ground plane 250 by the current flowing through the second radiator 220 are indicated by dotted arrows ⑦, ⑧, ⑨ and ⑩.

The current path ② formed at one side portion of the ground plane 250 by the current flowing through the first radiator 210 is in direction opposite to the current path ⑦ formed at the one side portion of the ground plane 250 by the current flowing through the second radiator 220. Accordingly, the current path ② and the current path ⑦ cancel each other.

In the same manner, the current path ④ formed at the other side portion of the ground plane 250 is in a direction opposite to the current path ⑨ at the other side portion of the ground plane 250. Accordingly, the current path ④ and the current path ⑨ cancel each other.

The ground surface 250 may act as a part of the antenna device as a current flows in the ground plane 250 connected to the first and second radiators 210 and 220. Thus, since the radiation characteristic of the antenna device varies according to an area of the ground part, tuning may be required. However, in the antenna device as in the current embodiment, some of the current paths formed in the ground plane 250 cancel each other. That is, the current paths ② and ⑦ cancel each other, and the current paths ④ and ⑨ also cancel each other. Only the current paths ③ and ⑧ among the current paths formed in the ground plane 250 can take part in forming a current path of the entire antenna device. Accordingly, changes in the area of the ground plane 250 may not significantly change an antenna characteristic.

Figure 3:
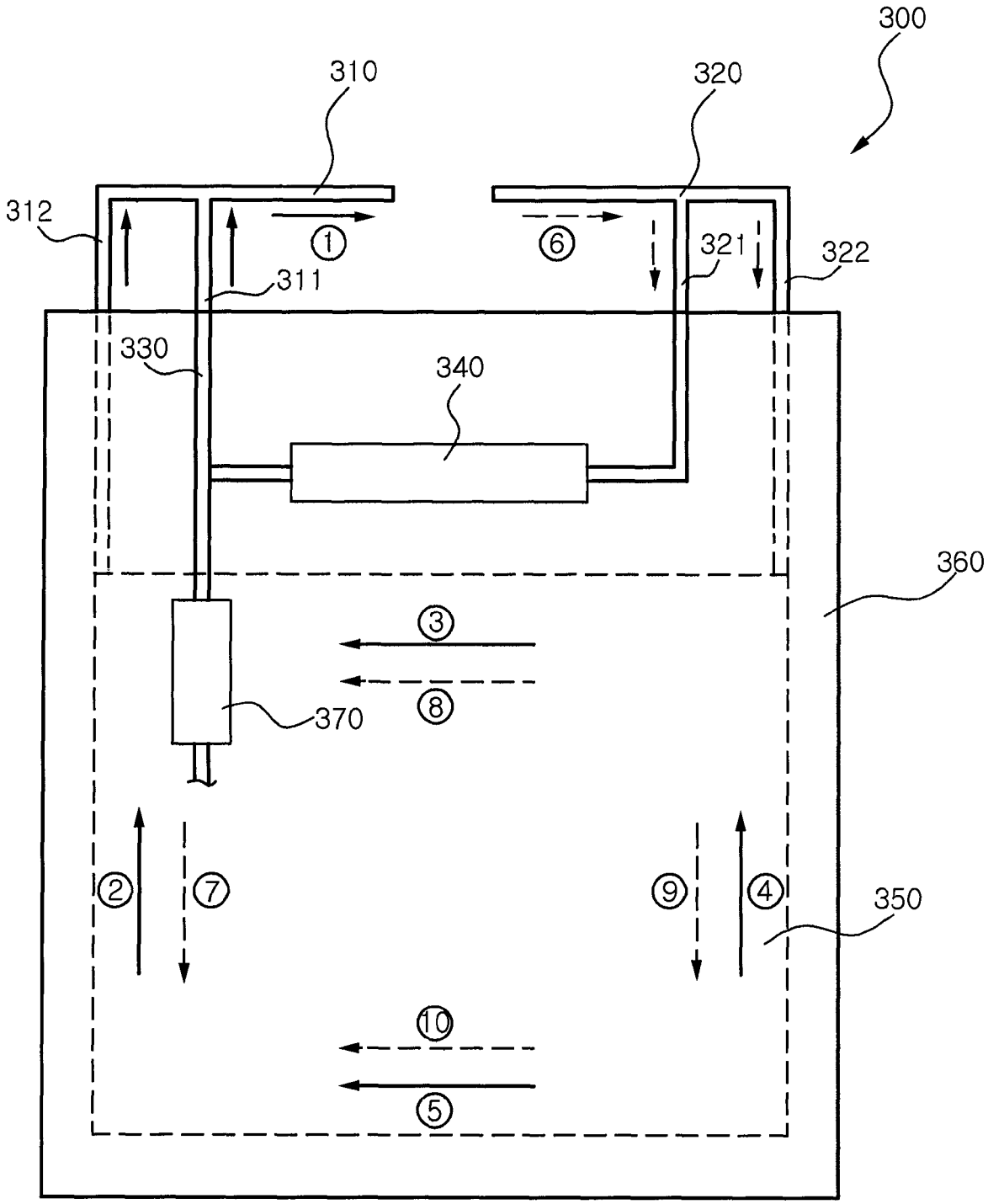
FIG. 3 is a configuration view of an antenna device according to still another exemplary embodiment of the present invention.

FIG. 3 is a configuration view of an antenna device according to still another exemplary embodiment of the present invention. Referring to FIG. 3, an antenna device 300 according to the current embodiment may include a first radiator 310, a second radiator 320, a feed line 330, a phase shifter 340, and an impedance matching device 370.

The first radiator 310 may include a feed terminal 311 and a ground terminal 312. The feed terminal 311 may be connected to a feed line 330, and the ground terminal 312 may be connected to a ground plane 350 disposed on a substrate 360. According to the current embodiment, an inverted F-shaped radiator is used as the first radiator 310. However, the present invention is not limited thereto, and the first radiator 310 may be implemented as an L-shaped radiator or a variety of shapes.

The second radiator 320 may be spaced apart from the first radiator 310 at a predetermined distance, and capacitively coupled with the first radiator 310. The second radiator 320 may include a feed terminal 321 and a ground terminal 322. The feed terminal 321 may be connected to the phase shifter 340, and the ground terminal 322 may be connected to the ground plane 350 disposed on the substrate 360. The second radiator 320 is a radiator having the same structure as that of first radiator 310, and may be arranged symmetrically with respect to the first radiator 310. According to the current embodiment, an inverted F-shaped radiator is used as the second radiator 320. However, the present invention is not limited thereto, and the second radiator 320 may be implemented as an L-shaped radiator or a variety of shapes according to the shape of the first radiator 310.

The feed line 330 may be disposed on one surface of the substrate 360. The feed line 330 may be connected to the feed terminal 311 of the first radiator 310 at a feeding part (not shown) formed at the substrate 360 and thus supply a feed signal to the first radiator 310.

The phase shifter 340 may diverge from the feed line 330 and be connected to the feed terminal 321 of the second radiator 320. The phase shifter 340 may supply a second feed signal to the second radiator 320. The second feed signal has a predetermined phase difference with a feed signal fed to the first radiator 310 through the feed line 330.

The phase shifter 340 may be formed as a strip line. The strip line of the phase shifter 340 may have an electrical length of $\lambda/2$ of a frequency signal input to the feed line 330, thereby causing a phase difference of 180 degrees between a signal input to the first radiator 310 and a signal input to the second radiator 320. The phase difference caused by the phase shifter 340 may be implemented differently in due consideration of surroundings and various circumstances.

The phase shifter 340 may include a plurality of conductive lines having different electrical lengths, and a switching circuit. The plurality of conductive lines may have electrical lengths of $\lambda/2$ for respectively different frequency signals. In this case, one of the conductive lines may be selected by the switching circuit depending on an incoming frequency signal.

The impedance matching device 370 may be formed at the feed line 330.

The impedance matching device 370 may allow broadband operation of the antenna device 300 by controlling an impedance of the antenna device 300. To control the impedance, an inductance component or a capacitance component may be controlled. The impedance matching device 370 may be implemented as an active device or a passive device or a combination of both so as to control the inductance component or the capacitance component.

According to the current embodiment of the present invention, a varactor diode, which is an active device, may be used as the impedance matching device 370. Since a capacitance value of the varactor diode changes when a bias voltage is applied, the varactor diode can control an impedance of the antenna device 300 by controlling the input bias voltage.

The ground plane 350 may be disposed on the other surface of the substrate 360.

The ground plane 350 may be connected to the ground terminal 312 of the first radiator 310 and to the ground terminal 322 of the second radiator 320.

The ground plane 350 connected to the first and second radiators 310 and 320 may act as a part of the antenna device as a current flows to the ground plane 350. Accordingly, since the entire radiation characteristic of the antenna device varies according to an area of the ground plane, tuning may be required.

An operational characteristic of the antennal device according to the current embodiment will now be described.

According to the current embodiment, when a feed signal is supplied to the first radiator 310 along the feed line 330, a current flows through the first radiator 110 in a first current-flow direction ①.

The phase shifter 340 supplies a signal that has a phase difference of 180 degrees with a signal of the feed line 330, to the second radiator 320. Thus, a current flows through the second radiator 320 in a second current-flow direction ⑥, which is identical to the first current-flow direction ① of the first radiator 310.

The first radiator 310 is spaced apart from the second radiator 320 at a predetermined distance. However, the first radiator 310 and the second radiator 320 may be electrically connected together by capacitive coupling, and the current flows in the same direction in both the first radiator 310 and the second radiator 320. Accordingly, the first radiator 310 and the second radiator 320 may form a loop providing one current path.

A current path may be formed in the ground plane 350 disposed on the other surface of the substrate 360 by the current path formed at the first and second radiators 310 and 320. First, current paths formed at the ground plane 350 by the current flowing trough the first radiator 310 are indicated by solid-line arrows ②, ③, ④ and ⑤. Current paths formed at the ground plane 350 by the current flowing through the second radiator 320 are indicated by dotted arrows ⑦, ⑧, ⑨ and ⑩.

The current path ② formed at one side portion of the ground plane 350 by the current flowing through the first radiator 310 is in direction opposite to the current path ⑦ formed at the one side portion of the ground plane 350 by the current flowing through the second radiator 320. Accordingly, the current path ② and the current path ⑦ cancel each other.

In the same manner, the current path ④ formed at the other side portion of the ground plane 350 is in a direction opposite to the current path ⑨ at the other side portion of the ground plane 350. Accordingly, the current path ④ and the current path ⑨ cancel each other.

The ground plane 350 may act as a part of the antenna device as a current flows in the ground plane connected to the first and second radiators 310 and 320. Thus, since the radiation characteristic of the antenna device varies according to an area of the ground part, tuning may be required. However, in the antenna device as in the current embodiment, some of the current paths formed in the ground plane 350 cancel each other. That is, the current path ② and ⑦ cancel each other, and the current paths ④ and ⑨ also cancel each other. Only the current paths ③ and ⑧ among the current paths formed in the ground plane 350 can take part in forming a current path of the entire antenna device. Accordingly, changes in area of the ground plane 350 may not significantly change an antenna characteristic.

According to the embodiments of the present invention, there is provided an antenna device that is capable of broadband operation and can realize a constant radiation characteristic even if a condition of a ground plane on a substrate to which an antenna is set changes.

While the present invention has been shown and described in connection with the exemplary embodiments, it will be apparent to those skilled in the art that modifications and variations can be made without departing from the spirit and scope of the invention as defined by the appended claims.

What is claimed is:

1. An antenna device, comprising:

a substrate;

a ground plane disposed on one surface of the substrate;

a feed line disposed on the other surface of the substrate;

a first radiator including:

a first feed terminal connected to the feed line to receive a first feed signal; and a first ground terminal connected to the ground plane;

a second radiator spaced apart from the first radiator at a predetermined distance and including:

a second feed terminal; and a second ground terminal connected to the ground plane; and a phase shifter diverging from the feed line and connected to the second feed terminal for supplying a second feed signal to the second radiator, the second feed signal having a predetermined phase difference with the first feed signal, wherein a first current path is formed in at least one side of the ground plane by a current flowing through the first radiator, wherein a second current path is formed in the at least one side of the ground plane by a current flowing through the second radiator, and wherein the first and second radiators are arranged such that a loop antenna providing one current path is formed by capacitive coupling between the first radiator and the second radiator to cause the currents in the first current path and the second current path to cancel each other.

2. The antenna device of claim 1, wherein the phase shifter causes the predetermined phase difference of 180 degrees between the first feed signal and the second feed signal.

3. The antenna device of claim 1, wherein the phase shifter comprises:

a plurality of conductive lines having respectively different electrical lengths; and a selection part for selecting one of the plurality of conductive lines.

4. The antenna device of claim 3, wherein the conductive lines have the electrical lengths of $\lambda/2$ for signals of different frequency bands, respectively.

5. The antenna device of claim 3, wherein the selection part is a switching circuit.

6. The antenna device of claim 1, wherein the first radiator and the second radiator are symmetrical with respect to each other.

7. The antenna device of claim 1, wherein each of the first radiator and the second radiator has an inverted F shape.

8. The antenna device of claim 1, further comprising an impedance matching device connected to the feed line.

9. The antenna device of claim 8, wherein the impedance matching device comprises an active device.

10. The antenna device of claim 9, wherein the active device comprises a varactor diode.

11. The antenna device of claim 1, wherein each of the first radiator and the second radiator has an L shape.

12. The antenna device of claim 1, wherein the phase shifter is formed as a strip line.

13. An antenna device, comprising:

a substrate;

a ground plane disposed on one surface of the substrate;

a feed line disposed on the other surface of the substrate;

a first radiator including:

a first feed terminal connected to the feed line to receive a first feed signal;

a first ground terminal connected to the ground plane; and a first free end extending from the first feed terminal and the first ground terminal;

a second radiator spaced apart from the first radiator at a predetermined distance and including:

a second feed terminal;

a second ground terminal connected to the ground plane, and a second free end extending from the second feed terminal and the second ground terminal; and a phase shifter diverging from the feed line and connected to the second feed terminal for supplying a second feed signal to the second radiator, the second feed signal having a predetermined phase difference with the first feed signal, wherein the first free end and the second free end face each other to form capacitive coupling between the first free end and the second free end so that a loop antenna providing one current path is formed by the first radiator and the second radiator.

* * * * *